US005552971A

United States Patent [19]

Madden

[11] Patent Number: 5,552,971

[45] Date of Patent: Sep. 3, 1996

[54] IN-LINE SKATE LIGHTS

[76] Inventor: Joel Madden, 522 SW. St. Lucie St., Stuart, Fla. 34997

[21] Appl. No.: 544,781

[22] Filed: Oct. 18, 1995

[51] Int. Cl.[6] ..... A63C 17/26

[52] U.S. Cl. ..... 362/61; 362/32; 362/103; 362/84; 362/800; 362/253; 280/811; 280/11.22

[58] Field of Search ..... 362/103, 84, 80, 362/32, 190, 191, 184, 234, 235, 249, 252, 61, 253, 806, 189; 280/11.19, 11.22, 816, 809, 811; 36/137

[56] References Cited

U.S. PATENT DOCUMENTS

| | | | |
|---|---|---|---|
| 2,502,566 | 4/1950 | Hooley | 240/6.4 |
| 4,240,132 | 12/1980 | Wickman | 362/103 |
| 4,363,502 | 12/1982 | Bakerman | 280/816 |
| 4,463,412 | 7/1984 | Broach | 362/61 |
| 4,652,981 | 3/1987 | Glynn | 362/103 |
| 4,812,953 | 3/1989 | Ask et al. | 362/103 |
| 4,991,066 | 2/1991 | McCowan | 362/61 |
| 4,997,196 | 3/1991 | Wood | 362/61 |
| 5,132,883 | 7/1992 | La Lumandier | 362/81 |
| 5,149,489 | 9/1992 | Crews | 362/32 |
| 5,278,733 | 1/1994 | St. Thomas | 362/78 |
| 5,294,188 | 3/1994 | Vancil | 301/5.3 |
| 5,327,329 | 7/1994 | Stiles | 362/253 |
| 5,469,342 | 11/1995 | Chien | 362/84 |
| 5,484,164 | 1/1996 | McInerney et al. | 280/11.22 |

OTHER PUBLICATIONS

Paragon Flasher & Paragon Skatelites Florida Sports Apr. 1995 p. 32.

*Primary Examiner*—Denise L. Gromada
*Assistant Examiner*—Thomas M. Sember
*Attorney, Agent, or Firm*—Alvin S. Blum

[57] ABSTRACT

An elongate light assembly for shoe skates removably encircles the skate frame below the shoe and is held in place by elastic tension. A plurality of light sources are positioned along the sides of the skate frame and are powered by a self-contained electric power source. The light sources may be a pair of elongate electroluminescent light sources or a plurality of LED's.

10 Claims, 1 Drawing Sheet

IN-LINE SKATE LIGHTS

FIELD OF THE INVENTION

This invention relates to skates and more particularly to lights disposed along the sides of skates below the shoes that are decorative and may enhance safety.

BACKGROUND OF THE INVENTION

Roller skating has always been a popular sport. The introduction of the in-line skate has greatly increased the popularity of the sport, especially for adults, who are more inclined to skate in the early morning and evening hours so as to not interfere with work schedules. These may be the most dangerous times to skate because motorists may not be able to see them. Adult skaters also like to wear distinctive costumes and decorative accessories when they skate.

Paragon skatelights are small flashlights that attach to the axle bolts of the skate and illuminate the path in front of the skater.

The Paragon flasher is a flashing LED light which may be clipped onto the skate to provide a single point source of flashing light. Neither of these products illuminate the length of the skate on both sides thereof to provide a distinctive and easily visible indication of the skaters presence.

SUMMARY OF THE INVENTION

It is, accordingly, an object of the invention to provide an elongate light source along each side of the skate below the shoe that is easily applied or removed without special skills or tools. It is another object that the device be readily adaptable to a variety of styles and sizes of skates including ice skates. It is another object that the device be sturdy of design to resist damage in the environment of use.

The skate lights of the invention comprise an elongate light source mounted below the shoe along each side of the skate. This may be in the form of a series of LEDs or an elongate electroluminescent light source. The lights may be lit continuously or periodically. A battery power source is included in the assembly. A single light source may be employed with a fiber optic light pipe directing light outwardly.

These and other objects, advantages and features of the invention will become more apparent when the detailed description is studied in conjunction with the drawings in which like elements are indicated by a common reference character.

DETAILED DESCRIPTION OF PREFERRED EMBODIMENTS

Figure 1:
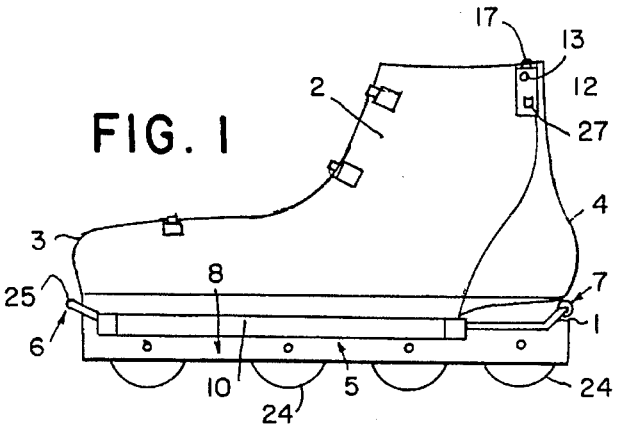
FIG. 1 is a side elevation view of a skate with the light assembly in place.
Figure 2:
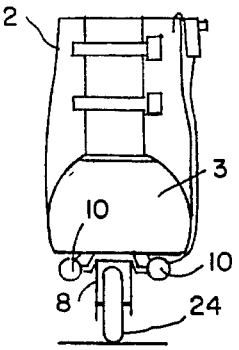
FIG. 2 is a front elevation view of the skate of FIG. 1.
Figure 3:
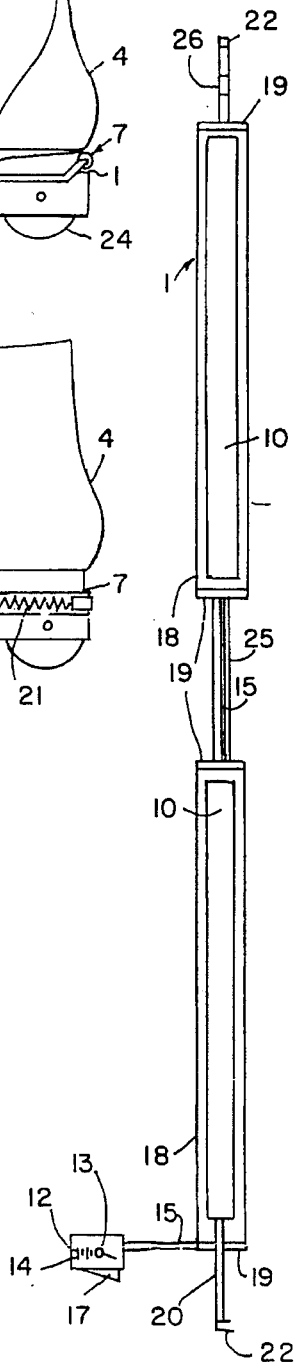
FIG. 3 is a top view of the light assembly of FIG. 4 opened and lain flat.

Referring now first to FIGS. 1–3, a skate shoe 2 has a heel 4 and toe 3. Attached to the underside is an in-line skate frame 5 with wheels 24. The frame has a toe portion 6, a heel portion 7 and long straight sides 8.

A light assembly 1 is removably attached to the frame 5 below the shoe so that the two elongate electroluminescent light sources 10 are arranged parallel to one another, one on each long side 8 of the frame. Each light source 10 is mounted within a strong, rigid, transparent tube 18. Each tube is capped by an end cap connector 19. A strong flexible tube 25 connects the tubes, providing a means for engaging the toe portion 6 of the frame so that the light sources can lie against the frame sides.

A length adjusting strap 26 of the type well known in the luggage art enables the overall length of assembly 1 to be adjusted for skate frames of various lengths. An elastic band 20 ensures tension when the assembly encircles the skate frame and clasps or connectors 22 at the ends of the assembly 1 are joined together. The clasps or connectors 22 may be any of those well known in the art such as buckles, hook and loop fasteners, clasps, or barbed snap connectors such as used on luggage straps.

The two light sources 10 are connected by wires 15 to an electric power source 12 which may clip to the shoe by spring clip 17. The power source 12 contains a battery 14, on-off switch and inverter 27.

Figure 4:
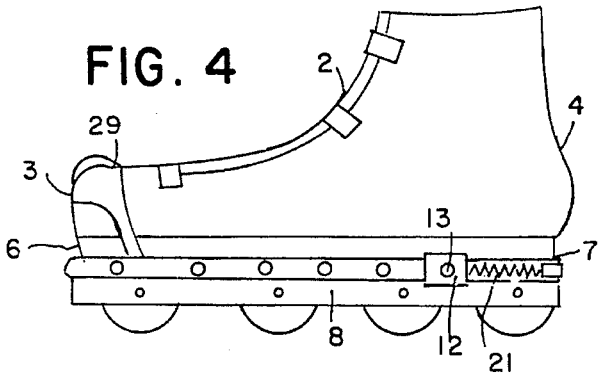
FIG. 4 is a side elevation view of a skate with another embodiment of the light assembly in place.
Figure 5:
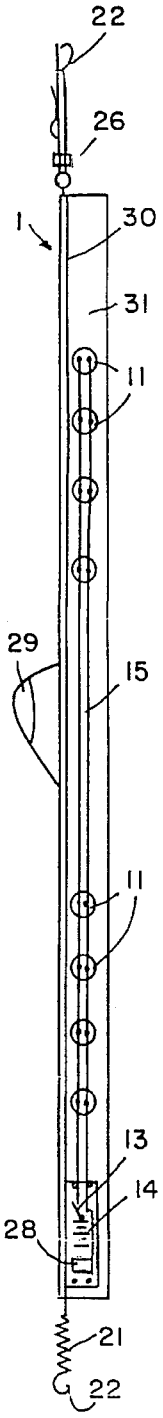
FIG. 5 is a top view of the light assembly of FIG. 4 opened and lain flat.

Referring now to an alternative embodiment 1 shown in FIGS. 4 and 5, a plurality of light emitting diodes (LED)'s 11 are wired to an electric power source 12 with on-off switch 13 by wires 15. A spring at one end provides elastic bias when the light assembly 1 is encircled about the skate frame 5. A length adjusting element 26 enables the assembly to be adjusted to fit any size skate frame and still provide sufficient elastic tension to hold the assembly firmly in place with the light sources arrayed along the sides of the frame. A strong cable or cord 30 runs along the assembly and is embedded with the power source 12 and the LEDs in a flexible matrix such as polyurethane elastomer. A branching elongate member. 29 is attached at both its ends to the cable 30. It is arranged to engage the toe 3 of the shoe while the cable 30 bends around the toe portion 6 of the frame to further secure the assembly in place, while the connectors 22 are joined at or near the heel portion 7 of the frame. The power source 12 may contain an interruptor circuit 28 to power the light sources intermittently or in sequence as desired. The LED's are arranged to emit light outwardly from the skate frame.

Figure 6:
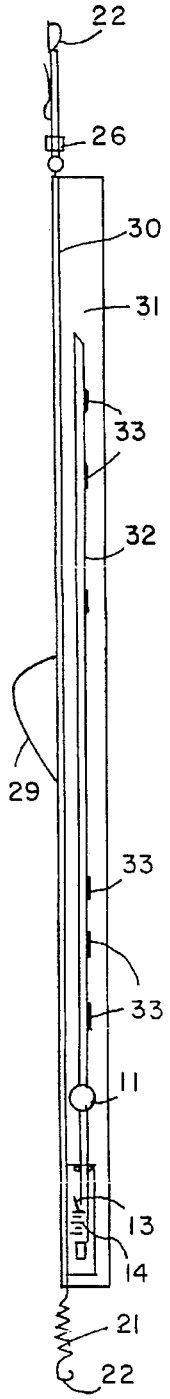
FIG. 6 is a top view of another embodiment of the invention.

Referring now to FIG. 6, the source of illumination may alternatively comprise one or more incandescent bulbs 11 coupled to fiber optic light pipe 32 to distribute light outwardly from the single source all along the length of the light pipe. The light may be diverted from its usual axial path in the light pipe by various means such as roughening the side 33 of the pipe or terminating some of the fibers.

The above disclosed invention has a number of particular features which should preferably be employed in combination although each is useful separately without departure from the scope. of the invention. While t have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A removable light assembly for a shoe skate having a shoe with heel and toe and a skate frame attached underneath the shoe, the skate frame having a heel portion, a toe portion, and two long sides, the assembly comprising:

an elongate support arranged to snugly encircle the skate frame below the shoe, bending around the heel portion and the toe portion and extending along both long sides, the support provided with length adjustment means for adapting to skate frames of various lengths and also provided with sufficient elasticity to enable the support to firmly engage the skate frame;

a plurality of light sources mounted on the support, the light sources being spaced apart from one another and arranged to emit light outwardly from the skate frame; and an electric power source connected to the light sources for activating the sources.

2. The assembly according to claim 1, in which the light sources include two elongate electroluminescent sources.

3. The assembly according to claim 2, in which the electric power source is mounted on the support.

4. The assembly according to claim 2, in which the electric power source is arranged to be mounted on the shoe.

5. The assembly according to claim 1, in which the light sources include light emitting diodes.

6. The assembly according to claim 5, in which the electric power source is arranged to be mounted on the shoe.

7. The assembly according to claim 5, in which the electric power source is mounted on the support.

8. The assembly according to claim 1, further including an elongate member arranged to mount over the toe of the shoe, the elongate member having ends attached to the support on either side of the skate frame.

9. The assembly according to claim 1, in which the light sources comprise a single light emitter coupled to a light pipe, in which the light pipe is adapted to transmit light outwardly in a direction transverse to an axial length thereof.

10. A removable light assembly for a shoe skate having a shoe with heel and toe and a skate frame attached underneath the shoe, the skate frame having a heel portion, a toe portion, and two long sides, the assembly comprising:

an elongate support arranged to snugly encircle the skate frame below the shoe, bending around the heel portion and the toe portion and extending along both long sides, the support provided with length adjustment means for adapting to skate frames of various lengths and also provided with sufficient elasticity to enable the support to firmly engage the skate frame;

at least one light emitter coupled to a light pipe and mounted on the support, in which the light pipe is arranged to emit light outwardly from the skate frame in a direction transverse to an axial length thereof; and an electric power source connected to the light emitter for activating the light emitter.

* * * * *